United States Patent [19]

Griswold

[11] Patent Number: 4,484,828

[45] Date of Patent: Nov. 27, 1984

[54] APPARATUS FOR APPLYING A CAP TO AND REMOVING THE CAP FROM A PIN

[75] Inventor: Augustus W. Griswold, Rush, N.Y.

[73] Assignee: Crosfield Data Systems, Inc., Springfield, Va.

[21] Appl. No.: 389,134

[22] Filed: Jun. 16, 1982

[51] Int. Cl.[3] ..... B42F 3/00; B41F 1/28

[52] U.S. Cl. ..... 402/60; 402/80 R; 101/407 R; 101/407 BP; 101/DIG. 12

[58] Field of Search ..... 101/DIG. 12, 407 R, 101/407 BP; 269/8, 309, 310; 402/60, 80 R

[56] References Cited

U.S. PATENT DOCUMENTS

| | | | |
|---|---|---|---|
| 2,108,039 | 2/1938 | Betls | 101/DIG. 12 |
| 3,222,051 | 12/1965 | Bevilocqua et al. | 101/407 R |
| 4,390,172 | 6/1983 | Gotman | 269/309 |

*Primary Examiner*—Paul A. Bell

*Attorney, Agent, or Firm*—William D. Hall

[57] ABSTRACT

A cap for securing a printing plate, sheet of paper, or other flat piece of material to a plate or bed having one or more registration pins, is provided. The cap has a resilient O ring for securing it to the pin. The cap is actually applied to, and removed from, the pin by a cap holding and releasing device. The cap holding and releasing device is mounted on an elevator which carries the printing plate (or paper etc.) to the bed and deposits it on the bed.

13 Claims, 8 Drawing Figures

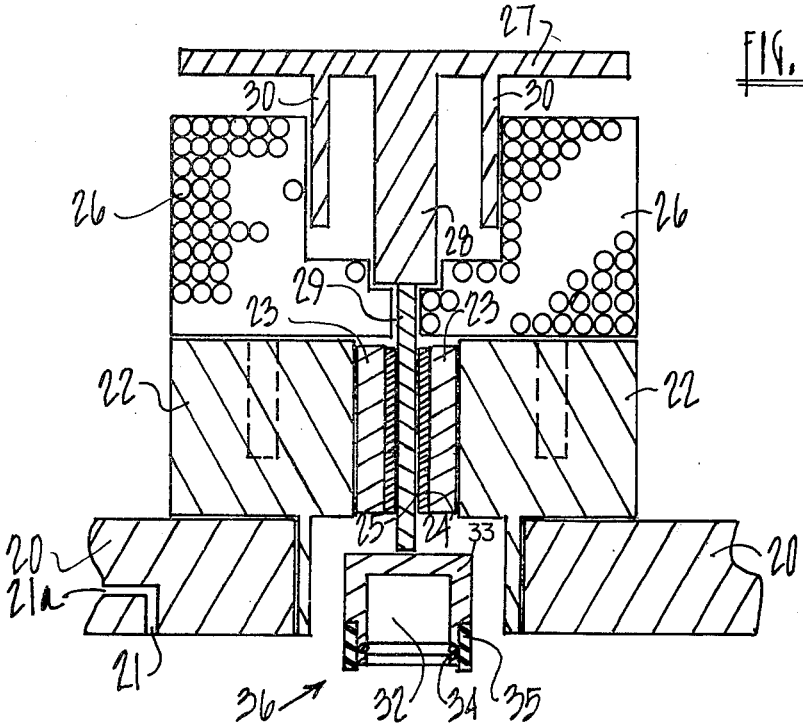
FIG. 1
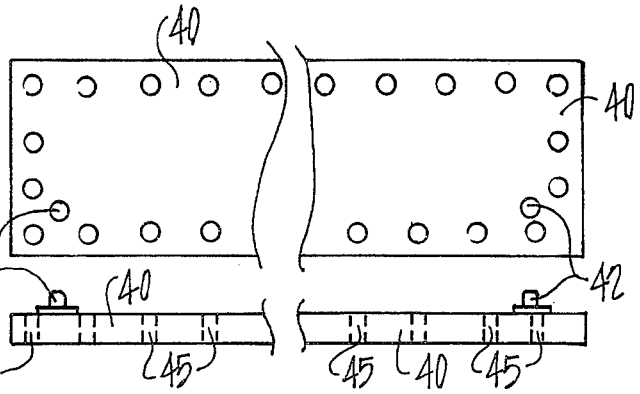
FIG. 2
FIG. 3
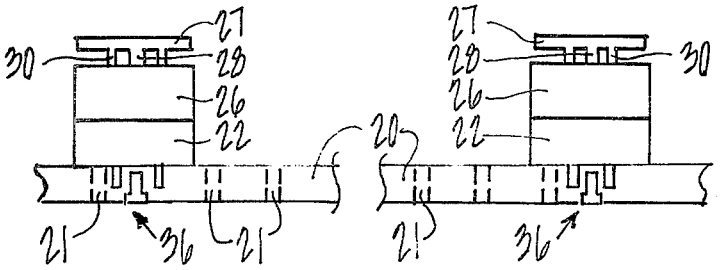
FIG. 4

APPARATUS FOR APPLYING A CAP TO AND REMOVING THE CAP FROM A PIN

TECHNICAL FIELD

This invention relates to devices for applying caps to, and removing caps from, pins.

DISCLOSURE OF INVENTION

In many arts, such as the printing art, it is desirable to have a pin, projecting upwardly from a bed, to accurately locate or register a printing plate, sheet of paper or the like on the bed. Since the printing plate, sheet of paper or the like may become inadvertently removed from the bed it is desirable to have a cap on the pin which frictionally engages the pin and, therefore, to a limited degree resists its removal from the pin. The present invention not only provides such a pin and cap, but also employs a cap holding means which may be part of a carrier or elevator that applies paper, printing plates, etc., to, and removes them from, the bed. As a printing plate, for example, is placed on the bed by the elevator, the cap holding means not only holds the cap but presses the cap onto the pin.

The cap holding means includes means to operate in either of two modes. In the first of these modes, hereinafter referred to as the "holding mode," the cap holding means holds the cap with sufficient force that even if the cap is on the pin and the cap holding means is moved away from the pin the cap will be removed from the pin notwithstanding the restraint resulting from the frictional engagement of the cap and pin. In the second mode, hereinafter referred to as the "release mode," the cap holding means applies little or no force to the cap. Therefore, after the cap has been applied to the pin during said holding mode, the release mode may be selected to thus permit the cap to remain on the pin while the cap holding means is removed from the vicinity of the pin.

When the cap holding means is in its holding mode, there is sufficient play to allow the cap to move laterally a substantial distance. Therefore, if the centerline of the cap is not in exact alignment with the centerline of the pin, the cap may move laterally as it is being applied to the pin, whereby the centerlines of the cap and pin are in alignment with each other.

BRIEF DESCRIPTION OF THE DRAWINGS

FIG. 1 is a cross sectional view of the cap holding means (in its release mode) together with a cap.

FIG. 2 illustrates a bed from which registration pins 41 and 42 project.

FIG. 3 is a side view of the bed of FIG. 2.

FIG. 4 is a side view of an elevator 20 with a cap holding means mounted thereon.

BEST MODE FOR CARRYING OUT THE INVENTION

Figure 5:
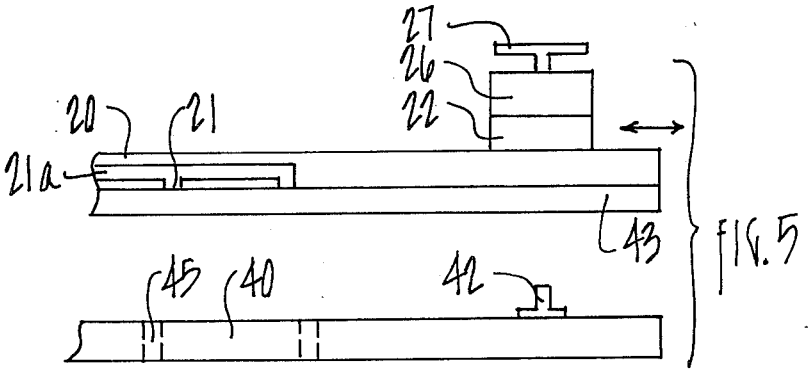
FIG. 5 illustrates an elevator 20 which is carrying a cap 36 which will subsequently be applied to pin 42.

An elevator 20 has a series of air holes 21 around its periphery. These air holes 21 are used to apply suction so that material such as a printing plate or a sheet of paper may be held onto the bottom flat surface of elevator 20.

The bed 40 has registration pins 41 and 42, and the printing plate or sheet of paper 43 (FIGS. 5 to 8) has holes through which the pins 41 and 42 pass when the printing plate or sheet of paper 43 is properly positioned on the bed 40.

The cap 36 has a body 33 made of soft iron or other material which will be attracted by a permanent magnet. The cap 36 defines a cylindrical cavity 32 and also has a resilient O ring 34 which projects slightly into the cavity 32 so as to frictionally engage the outer surface of pin 42. This frictional engagement will hold the cap 36 firmly on the pin 42.

The cap 36 also has an annular resilient pad 35 which engages the printing plate or sheet of paper 43 and prevents leakage of air around the pin 42.

The cap holding means comprises the following:

(a) a main body 22,
(b) two permanent magnets 23
(c) a non-magnetic tube 24 defining a hole 25
(d) solenoid 26
(e) solenoid armature 28 and pin 29
(f) cover 27 with skirt 30.

The cap holding means has two modes as follows:

The "holding mode" continues as long as the solenoid 26 is deenergized. In this mode the permanent magnets 23 attract cap 36 and hold the cap 36 firmly against the magnets 23. In this mode, the holding power of the magnets 23 is so strong that if the cap 36 is on pin 42, and if the elevator 20 is then moved upward the cap 36 will be pulled off of pin 32. In other words the holding power of magnets 23 is sufficient to overcome the frictional engagement between cap 36 and pin 42.

The device is in its "release mode" when the solenoid 26 is energized. The force placed on pin 29 when the solenoid is energized is sufficient to push the cap 36 out of contact with the magnets 23. In this mode there is no holding power on cap 36 by the magnets 23.

The overall operation is as follows.

Assume that it is desired to place the printing plate 42 on the bed 40 and to hold it in place with caps 36.

The bed 40 will remain in a fixed location during the following operations.

The elevator 20 (FIGS. 1 and 5) has the cap holding means together with a cap 36. Unlike FIG. 1, however, the cap holding means is in its "holding mode"; that is the cap 36 is in physical contact with magnets 23. The printing plate 43 is held against the lower face of elevator 20 by reason of suction. The various holes 21 around the periphery of the elevator 20 have suction applied at their upper ends via a suitable manifold 21*a*, and the printing plate 43 is held against the lower face of elevator 20 by reason of vacuum in holes 21.

Figure 6:
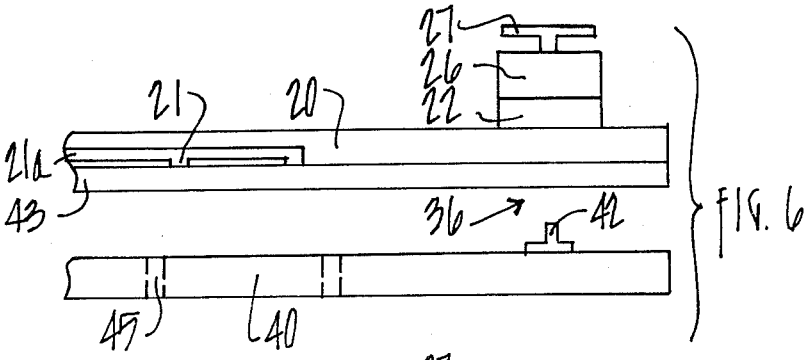
FIG. 6 shows the elevator 20 after it has moved to a position where it may place printing plate 42 onto bed 40. In this position there is at least approximate alignment of the centerlines of the cap and the pin respectively.

As shown in FIG. 5 the elevator 20 is movable, and as shown in FIG. 6, it is moved until the holes in printing plate 43 align with the pins 42, at which time the centerline of cavity 32 is approximately aligned with the centerline of pin 42.

The elevator 20 is next lowered to place the printing plate 43 on the bed 40. At the same time the cap 36 moved onto pin 42. If the centerlines of the cap 36 and the pin 42 are not in alignment, the cap 36 moves transverse to its centerline until its centerline is aligned with that of the pin 42. The diameter of cap 36 is smaller than the diameter of the cavity in the cap holding means to allow for the transverse movement just mentioned.

Figure 7:
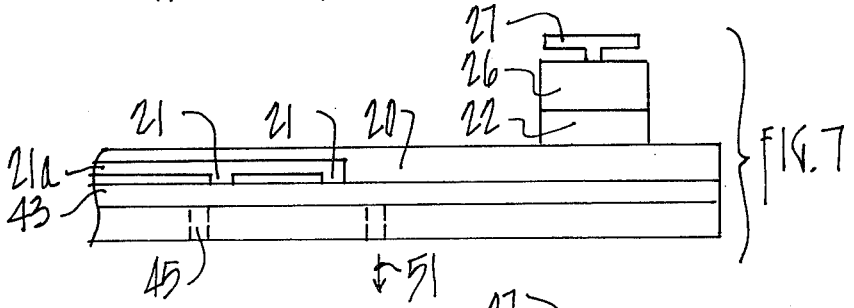
FIG. 7 illustrates the apparatus of FIG. 6 after the printing plate 43 has been placed on bed 40 and the caps 36 have been placed on the pins 42.

Therefore, in FIG. 7 the elevator or carrier 20 has moved the printing plate 42, and the cap 36 (not shown) on pin 42 (not shown). Suction is applied to the lower ends of holes 45 in bed 40 to hold the printing plate firmly against the bed 40.

Figure 8:
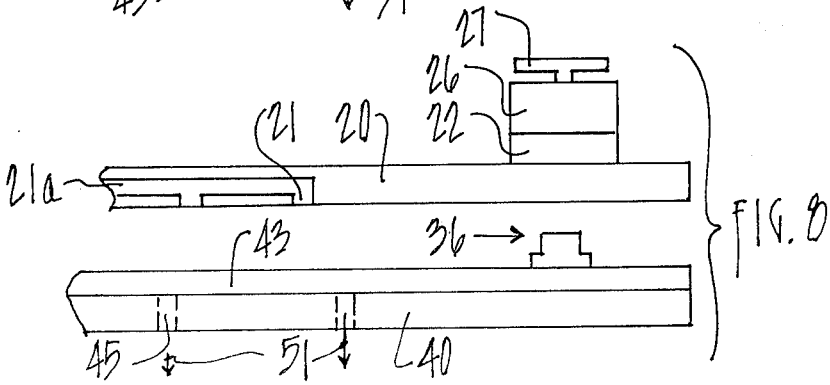
FIG. 8 shows the apparatus of FIG. 7 after the elevator 20 has moved away from bed 40 and the cap 36 is on the pin 42.

If it is desired to remove the elevator 20 from a position adjacent bed 40, the solenoid 26 is energized. This causes solenoid 26 to attract armature 28 which pushes downwardly on the pin 29 to apply sufficient pressure on cap 36 so that the cap 36 remains on the pin 42 notwithstanding the magnets 23. The elevator 20 may, therefore, be raised, as shown in FIG. 8, leaving cap 36 on the pin 42. The printing plate 43 remains on bed 40 since vacuum is applied to holes 45 but not to holes 21.

The bed 40 and the printing plate may now be sent to a scanning device or other processing machinery. During all such operations the plate 43 will be held in place not only by the vacuum in holes 45 but also by the caps 36.

After the printing plate 43 has been processed, it is desirable to remove it from the bed 40. To do this, the elevator 20 is moved into the position shown in FIG. 7. The solenoid 26 is now deenergized to place the cap holding means in its "holding mode", the vacuum is no longer applied to holes 45, and vacuum is applied to holes 21. The elevator 20 is next raised. The holding power of magnets 23 overcomes the frictional engagement between cap 36 and pin 42, and the printing plate is held by the vacuum in holes 21. Therefore, as the elevator 20 is raised, the cap 36 and the printing plate 43 are raised with it. The printing plate 43 can be easily removed from elevator 20 as soon as the vacuum in holes 21 is turned off.

As a result, this invention provides means for easily and automatically applying a cap to and removing a cap from, a pin that is on a bed.

I claim to have invented:

1. In a device for applying a cap to and removing it from a pin, said cap having an elongated cavity for receiving the pin, the cap having means associated with said cavity for frictionally engaging the pin to hold the cap to the pin, the cap, however, being removable from the pin upon application of sufficient force to overcome said frictional engagement holding the cap to the pin, the improvement comprising:

cap holding means for positioning said elongated cavity in substantial alignment with the pin and pressing the cap on the pin with the pin extending into said cavity, said cap holding means including means for selectively holding and releasing the cap, and, means operable to place the cap holding means in its holding mode, or to place it in its release mode; so that when it is desired to hold the cap away from the pin and then press the cap on the pin the cap holding means may be placed in its holding mode and when it is desired to remove the cap holding means from the vicinity of the pin the cap holding means may be placed in its release mode, and so that when it is desired to remove the cap from the pin the cap holding means may be placed around the cap and placed in its cap holding mode and then pulled away from the pin whereby the holding force of the cap holding means will be greater than the force required to remove the cap from the pin.

2. In a device as defined in claim 1:

said cap holding means having a supporting body which permits the cap to have limited lateral movement with respect to the centerline of the pin so that if the cap holding means moves the cavity in the cap toward the pin but without alignment between the centerlines of the cavity and the pin respectively, the cap can move laterally to effect alignment of said centerlines.

3. In a device as defined in claim 2, said cap holding means defining a cavity in which said cap is held, said last-named cavity having an inner end comprising magnet means and an open outer end, said cap including material attracted by said magnet means whereby said holding mode is achieved.

4. In a device as defined by claim 3, said cap holding means including selectively operable means for pushing the cap away from said magnetic means, to place the device in said release mode.

5. In a device as defined in claim 4, said magnetic means and the cap having such strong attraction for each other so that when the cap holding means tends to pull the cap away from said pin, when the cap holding means is in said holding mode, the force on the cap will be sufficient to pull the cap off of said pin.

6. In a device as defined in claim 1, said cap holding means including magnetic means for holding said cap, said cap including material that is attracted by said magnetic means.

7. In a device as defined in claim 6, selectively operable means for moving the cap away from said magnetic means to place the device in said release mode.

8. In a device as defined in claim 7, said cap holding means defining a cavity in which it holds the cap, said cavity, being larger in a direction transverse to the centerline of the pin than the cap, so that the cap may move transversly with reference to the centerline of the pin, if necessary, in order for the cap to be placed on the pin.

9. In a device for applying a cap to and removing the cap from a pin, said cap having an elongated cavity for receiving the pin, the cap having means associated with said cavity for frictionally engaging the pin to hold the cap to the pin, the cap, however, being removable from the pin upon application of sufficient force to overcome said frictional engagement holding the cap to the pin.

the improvement comprising:

a cap holder switchable between (a) a first mode in which a cap is held by the cap holder and (b) a second mode in which a cap is not held by the cap holder;

means for selectively positioning the cap holder in at least substantial alignment with a pin; and control means for (a) directing a cap holder, when in the first mode and holding a cap, toward a receiving pin when the cap holder and the receiving pin are at least substantially aligned by the positioning means; (b) pressing the cap held by the cap holder onto the receiving pin; and (c) switching the cap holder into the second mode thereof;

said control means including means for withdrawing the cap holder, when in the first mode, with the cap held thereto, from the pin, thereby effecting removal of the cap from frictional engagement with the pin.

10. In a mechanism comprising a bed for receiving a substantially flat piece of material, said bed having at least one registration pin extending therefrom for positioning the material on the bed, and a carrier for carrying the material to a predetermined position relative to the bed and then placing the material on the bed properly registered by said pin, the improvement comprising:

a cap having an elongated cavity that fits around said pin, said cap frictionally engaging the pin to thereby hold the cap on the pin, said elongated cavity having a centerline, a cap holding means on the carrier which holds the cap with the centerline of said elongated cavity in approximate alignment with the centerline of the pin, when the carrier is in said predetermined position, said cap holding means including means for (a) selectively holding the cap with sufficient force that the cap is pulled off of the pin when the carrier is moved away from the pin, and (b) selectively releasing the cap from the cap holding means so that the cap is not held by the cap holding means whereby the carrier may be moved away from the pin without removing the cap from the pin.

11. In a mechanism as defined in claim 10, said cap holding means including means for selecting either of two modes of operation of said cap holding means, one of which modes comprises the cap holding means holding the cap and the other of which modes comprises the cap holding means releasing the cap.

12. In a mechanism as defined in claim 10, said cap holding means providing for movement of said cap laterally with respect to the centerline of the pin so that said elongated cavity will receive the pin even though the centerlines of said cavity and of said pin are not in exact alignment when the cap first engages the pin.

13. In a mechanism as defined by claim 12, said cap holding means including means for selectively operating the cap holding means to either hold the cap or to release the cap.

* * * * *